US006856081B2

(12) United States Patent
Cattelino et al.

(10) Patent No.: US 6,856,081 B2
(45) Date of Patent: Feb. 15, 2005

(54) METHOD AND APPARATUS FOR MAGNETIC FOCUSING OF OFF-AXIS ELECTRON BEAM

(75) Inventors: Mark J. Cattelino, Palo Alto, CA (US); Fred I. Friedlander, Saratoga, CA (US)

(73) Assignee: Communications & Power Industries, Inc., Palo Alto, CA (US)

( * ) Notice: Subject to any disclaimer, the term of this patent is extended or adjusted under 35 U.S.C. 154(b) by 50 days.

(21) Appl. No.: 10/192,772

(22) Filed: Jul. 9, 2002

(65) Prior Publication Data

US 2004/0007959 A1 Jan. 15, 2004

(51) Int. Cl.[7] ..... H01J 29/70

(52) U.S. Cl. ..... 313/442; 313/414; 313/421; 313/446

(58) Field of Search ..... 313/442, 414, 313/421, 443, 446

(56) References Cited

U.S. PATENT DOCUMENTS

| | | | | |
|---|---|---|---|---|
| 3,278,793 | A | 10/1966 | Dehn | 315/5.14 |
| 3,932,786 | A | 1/1976 | Campbell | 315/3 |
| 3,970,890 | A | 7/1976 | Linssen | 313/413 |
| 4,433,270 | A | 2/1984 | Drozdov et al. | 315/5.35 |
| 4,733,131 | A | 3/1988 | Tran et al. | 315/5.14 |
| 5,032,763 | A | 7/1991 | Mourier | 315/5.35 |
| 5,838,107 | A | 11/1998 | Beunas et al. | 315/5.16 |
| 5,932,972 | A | 8/1999 | Symons | 315/5.16 |
| 6,147,447 | A | 11/2000 | Beunas et al. | 313/446 |
| 6,153,970 | A | 11/2000 | Chen et al. | 313/412 |

FOREIGN PATENT DOCUMENTS

| | | | |
|---|---|---|---|
| EP | 0724 281 A2 | 7/1996 | H01J/23/087 |
| FR | 1.324.415 | 11/1962 | |
| FR | 2 786 022 | 5/2000 | H01J/23/22 |
| RU | 2069026 | 11/1996 | H01J/23/06 |
| SU | 1136666 A1 | 3/1994 | H01J/23/06 |
| WO | WO 00/30144 | 5/2000 | H01J/25/02 |

OTHER PUBLICATIONS

George Caryotakis, "The Klystron: A Microwave Source of Surprising Range and Endurance", SLAC–PUB–7731, Jan. 1998, pp.1–13.

*Primary Examiner*—Joseph Williams
*Assistant Examiner*—Kevin Quarterman
(74) *Attorney, Agent, or Firm*—Thelen Reid & Priest, LLP

(57) ABSTRACT

Axially symmetric magnetic fields are provided about the longitudinal axis of each beam of a multi-beam electron beam device. The magnetic field symmetry is independent of beam voltage, beam current and applied magnetic field strength. A flux equalizer assembly is disposed between the cathodes and the anodes and near the cathodes of a multi-beam electron beam device. The assembly includes a ferro-magnetic flux plate completely contained within the magnetic focusing circuit of the device. The flux plate includes apertures for each beam of the multi-beam device. A flux equalization gap or gaps are disposed in the flux plate to provide a perturbation in the magnetic field in the flux plate which counters the asymmetry induced by the off-axis position of the beam. The gaps may be implemented in a number of ways all of which have the effect of producing a locally continuously varying reluctance that locally counters the magnetic field asymmetry. The flux equalizer assembly prevents or substantially reduces beam twist and maintains all of the electron beams of the device as linear beams.

24 Claims, 10 Drawing Sheets

METHOD AND APPARATUS FOR MAGNETIC FOCUSING OF OFF-AXIS ELECTRON BEAM

FIELD OF THE INVENTION

The present invention relates to the field of electron beam devices. More particularly, the present invention relates to the magnetic focusing of plural off-axis electron beams in a device with multiple linear beams. Such devices include, for example, microwave power amplifiers and oscillators, inductive output tubes, klystrons and the like.

BACKGROUND OF THE INVENTION

In linear beam electron tubes the source of electrons is a cathode, which, to achieve low electron emission densities, is usually larger than the desired beam diameter. Electrons emitted by the cathode are acted upon by a set of electrodes with voltages impressed thereon which causes the electrodes to accelerate and optically focus the electrons to the desired beam size. The magnetic focusing field than constrains the beam and prevents it from spreading. The magnetic focusing field can be produced either by electromagnets, permanent magnets, or a combination of the two.

There are two preferred systems for focusing linear electron beam devices. One system is called Brillouin focusing in which shielding is used to prevent leakage of any of the magnetic focusing field into the cathode and beam-forming region. Nearly all the desired magnetic focusing field is introduced abruptly at or near the point the beam reaches its desired diameter.

A second focusing system is termed "confined-flow" focusing. In this system a magnetic focusing field is "leaked" into the cathode and beam-forming region in a controlled manner such that the magnetic field force lines are essentially aligned with the optical electron trajectories. In this case the magnetic focusing field approaches its full value near the point where the beam reaches its desired diameter.

Of these two focusing systems, Brillouin focusing is the weaker of the two because of the necessity to match the magnitude of the focusing field to the electron energy to properly focus the beam. The result is weaker focusing and a beam more susceptible to defocusing effects caused by rf-field interactions with the beam. Confined-flow focusing, by contrast, uses focusing fields that typically are at least two times stronger than the Brillouin focusing fields for the same device. Thus Brillouin focusing, which is a simpler system, is generally used for lower power applications, and confined-flow focusing is used almost exclusively with higher power devices.

Both of these focusing systems, when appropriately applied, work well for focusing devices with a single linear beam. In such cases the beam axis and the focusing field axis can be aligned to achieve radial and azimuthal symmetry, and the design problem becomes essentially one-dimensional—only the magnitude of the axial magnetic field must be controlled.

It has long been recognized that the designers of electron devices with multiple linear beams face a difficult 3-dimensional design problem. Much of this problem has been avoided in many of the existing multiple-beam devices by using Brillouin focusing. However, this has limited the power levels achieved. It is a purpose of this invention to teach a novel method of applying confined-flow focusing to multiple beam devices, thus opening the way for new and higher power multiple beam devices.

The electron beam is focused by a magnetic field so as to produce a beam in the RF interaction circuit of the device having a somewhat smaller diameter than the inside (or minimum) diameter of the circuit and with minimal or low scalloping. To accomplish this with a convergent electron beam (due to the cathode or emitter being of larger diameter than the desired diameter in the RF interaction circuit), an appropriate magnetic circuit (including permanent magnets and/or a solenoid) is used to shape the magnetic field along the length of the device. In the case of multiple beams, however, the beam axes are not coincident with the axis of the magnetic circuit. In such a case, extra effort must be made in the design phase to assure adequate symmetry of the magnetic focusing field within the electron beams to avoid beam interception on the RF interaction circuit. This is particularly critical for confined-flow focused beams for which a magnetic field is present in the gun and cathode region of the device.

Confined-flow magnetic focused multiple beam devices are known. In such devices, the asymmetric magnetic field (with respect to the electron beam) typically causes the individual electron beams to twist or corkscrew in a helical pattern about the axis of the electron beam as they progress from the cathode toward the anode. Devices employing confined-flow magnetic focusing therefore must take into account this twisting. This is often accomplished by placing a series of apertures along the anticipated path of the beam with the apertures arranged so that the beam is (hopefully) centered on the apertures' respective longitudinal axes. The apertures need to be spatially offset from location to location along the beam(s) so as to properly intercept the beam(s).

Some designs for multi-beam devices cluster the cathode emitters near the longitudinal axis of the device so that the individual beam axes are disposed near the axis. This technique reduces, but does not entirely eliminate, the twisting of the beam. Such devices typically have performance limitations, including device life and operating voltage limitations, that result from space restrictions caused by placing the individual beams near the longitudinal axis of the device.

Various methods for achieving magnetic field symmetry equalization have been employed. These include using individual cathode coils to shape the magnetic field, an approach which can be difficult and complex to implement. Bulky and heavy iron field-shaping elements have been suggested for use in this application together with employing displacements in the position of the beam apertures, as described above, in the gun magnetic polepiece, to achieve magnetic field symmetry.

A problem with prior confined-flow multi-beam devices that employ offset pole-piece apertures to aid in focusing the beams is that the apertures, which are fixed in position, will be properly positioned for only one set of operating conditions because the amount of twist depends upon beam current and voltage and magnetic field strength. If the device is operated outside of the specified designed-in conditions, the beam will intersect with portions of plates through which the apertures are placed at places other than the apertures resulting in damage to the device and non-optimal operation, or the beam will pass off-center through the apertures (rather than hitting the polepiece) and thereby induce further field asymmetry and therefore suffer greater beam twist.

Confined-flow multi-beam devices with beams disposed near the device axis additionally suffer from performance limitations that result from space restrictions within the device. These limitations include shorter device life due to higher operating cathode current density, operating voltage limitations due to higher electrode voltage gradients, and mechanical and thermal design challenges imposed by the requirement to work within a restricted space.

BRIEF DESCRIPTION OF THE INVENTION

Axially symmetric magnetic fields are provided about the longitudinal axis of each beam of a multi-beam electron beam device. The magnetic field symmetry is independent of beam voltage, beam current and applied magnetic field strength. A flux equalizer assembly is disposed between the cathodes and the anodes and near the cathodes of a multi-beam electron beam device. The assembly includes a ferromagnetic flux plate completely contained within the magnetic focusing circuit of the device. The flux plate includes apertures for each beam of the multi-beam device. A flux equalization gap or gaps are disposed in the flux plate to provide a perturbation in the magnetic field in the flux plate which counters the asymmetry induced by the off-axis position of the beam. The gaps may be implemented in a number of ways all of which have the effect of producing a locally continuously varying reluctance that locally counters the magnetic field asymmetry. The flux equalizer assembly prevents or substantially reduces beam twist and maintains all of the electron beams of the device as linear beams.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION

Figure 1:
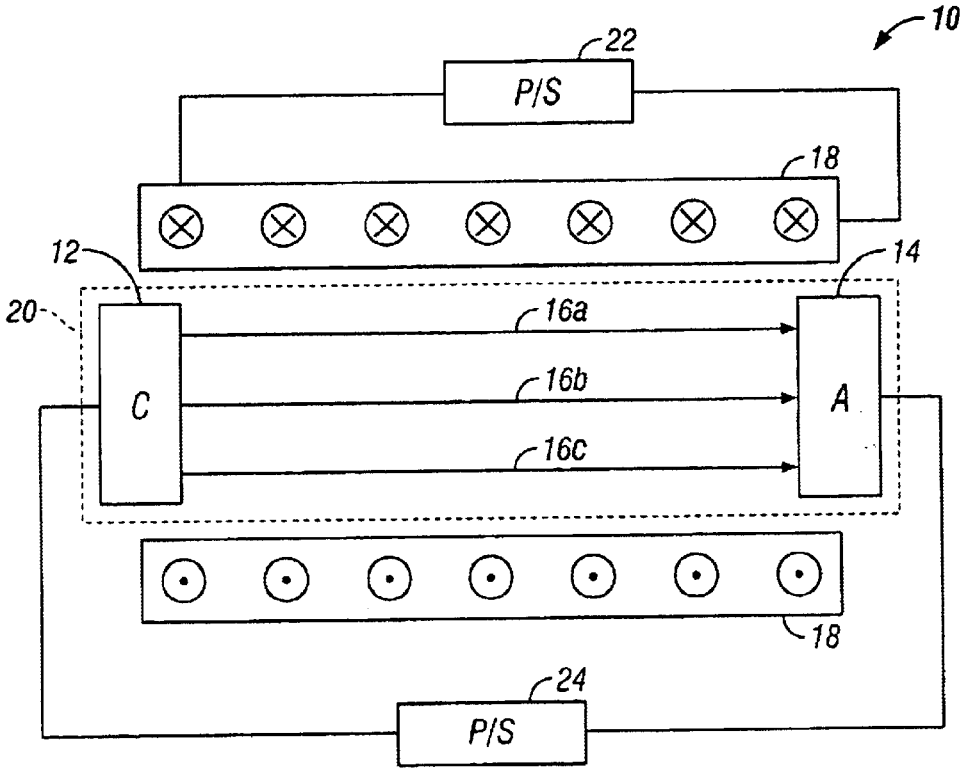
FIG. 1 is a basic electrical schematic diagram of a multi-beam electron device illustrated in block form.

Embodiments of the present invention are described herein in the context of a method and apparatus for magnetic focusing of off-axis electron beams. The invention is intended to be useable with a broad range of multi-beam electron devices as well as single-beam linear electron devices employing an off-axis electron beam. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In a single-beam electron device such as a microwave vacuum device such as a Klystron, Inductive Output Tube (IOT) and the like, a magnetic focusing field is generally produced by a magnetic circuit comprising a solenoid and/or permanent magnets which is a source of a radially symmetric magnetic field that has its longitudinal axis coincident with the longitudinal axis of the electron beam. In a typical multi-beam device, the magnetic circuit surrounds a cluster of electron beams. Since all of the beams cannot occupy the central longitudinal axis of the device, all but at most one of the beams and perhaps all of the beams will be offset some distance from that axis. Consequently the beams will not be all be coincident with the longitudinal axis of the magnetic circuit and absent some corrective action the magnetic circuit will impose an asymmetric force on the electrons traveling from source (cathode) to collector (anode) within the device. This asymmetric force usually manifests itself by imposing a twist in the beam, as discussed above. The present invention provides magnetic compensation locally about the off-axis electron beams in the region of the cathode so that the beams do not exhibit any substantial twist. Moreover, the benefits of the invention are received regardless of the operating conditions of the device (current, voltage, applied magnetic field strength) and thus no stringent operational conditions are imposed by reason of using this corrective approach.

Turning now to FIG. 1 a basic electrical schematic diagram of a multi-beam electron device 10 is illustrated in block form. A cathode assembly acts as a source of electrons 12 and may comprise one or more individual cathodes for releasing electrons. A collector assembly 14 receives the electrons after they have traveled the length of the device 10 over one of a plurality of beams 16*a*, 16*b*, 16*c* (collectively referred to as 16). A conventional magnetic circuit 18 surrounds the beams. A vacuum envelope 20 contains the source assembly 12, the collector assembly 14 and the beams 16. A first power supply 22 provides power to the magnetic circuit where required (as in the case where the magnetic circuit comprises a solenoid). A second power supply 24 provides bias to accelerate the electrons from the source assembly 12 to the collector assembly 14. A third power supply, not shown, typically provides power to the cathode(s) to assist in the thermionic release of electrons. The collector assembly may be of any convenient design including, but not limited to a single stage collector held at a single fixed potential or a multi-stage depressed collector (MSDC) which includes a plurality of stages each held at a different potential. RF circuits which would typically be a part of such a device have been omitted for clarity.

In accordance with one embodiment of the invention, axially symmetric (axisymmetric) magnetic fields are provided locally about the longitudinal axis of each off-axis beam of the electron beam device which may be a multi-beam device. The magnetic field symmetry is independent of beam voltage, beam current and applied magnetic field strength. A flux equalizer assembly is disposed between the cathodes and the anodes and near the cathodes of the device. The assembly includes a ferromagnetic flux plate completely contained within the magnetic circuit of the device. The flux plate includes beam apertures for each beam. A flux equalization ring is disposed within each aperture and concentrically about the beam. A gap which varies in size azimuthally between the flux equalization ring and the flux plate provides a local correction for the magnetic field. A flux equalization cylinder, associated with each flux equalization ring, also disposed concentrically about the beam, ensures that the highly symmetric magnetic flux density is maintained in the cathode region. The flux equalizer assembly prevents or substantially reduces twist.

Figure 2:
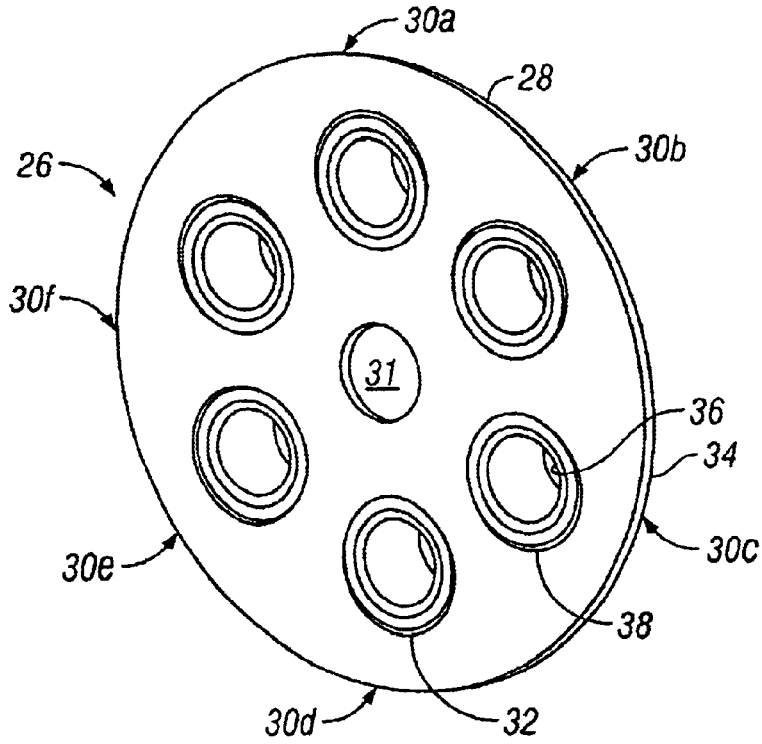
FIG. 2 is an anode side perspective view of a flux equalizer assembly in accordance with one embodiment of the present invention.

FIG. 2 is an anode side view of the flux equalizer assembly 26 for a six-beam electron tube (six off-axis beams) which comprises a plurality of magnetic field shaping elements. The flux equalizer assembly 26 includes a ferromagnetic flux plate 28 fabricated from a material comprising a ferromagnetic element such as iron, nickel or the like. Flux plate 28 includes a beam aperture 30*a*, . . . , 30*f* (collectively referred to as 30), for each beam. In accordance with one embodiment of the invention the beam apertures 30 are all circular and each includes a wall 32. The central aperture, 31, may be included for weight reduction or mechanical clearance during gun construction. It does not affect magnetic field symmetry. Apertures 30*a*, . . . , 30*f* are all offset from the longitudinal axis of the device and therefore require a magnetic correction. In each of the apertures 30 is disposed a flux equalization ring 34 which surrounds and is in contact (in one embodiment) with a flux equalization cylinder 36. The outer diameter of flux equalization ring 34 is less than the inner diameter of the corresponding aperture. As a result, there is a gap 38 ("flux equalization gap") between the flux equalization ring and the corresponding aperture. In one embodiment each of the aperture, flux equalization ring 34 and flux equalization cylinder 36 are circular in cross section and concentric with the beam axis as shown in FIG. 2 and the gap distance is maximized at the farthest distance from the center of the flux plate 28 and minimized or zero at the nearest distance to the center of flux plate 28.

In one embodiment, flux plate 28 is a magnetically floating structure, disposed entirely within the focusing magnetic circuit 18 and separated from the pole pieces of the magnetic circuit (not shown) and return path (not shown) by a much higher reluctance vacuum gap. The primary function of the flux plate 28 is to shape the magnetic flux in a manner consistent with space-charge balanced confined flow focusing of the beams. The outer diameter of the flux plate 28 and the diameters of the individual beam apertures 30 are parameters which are selected as described below to achieve the desired flux shaping. The thickness of the flux plate 28 also affects flux shaping to a lesser degree. It is also possible to affect flux shaping by adjusting the mechanical details of the flux plate and the shape of apertures 30 as by adding tapers, chamfers, radiused edges, cutouts, holes, bosses, protrusions, or by making the various components non-circular (e.g., oval or complex shapes).

Figure 3:
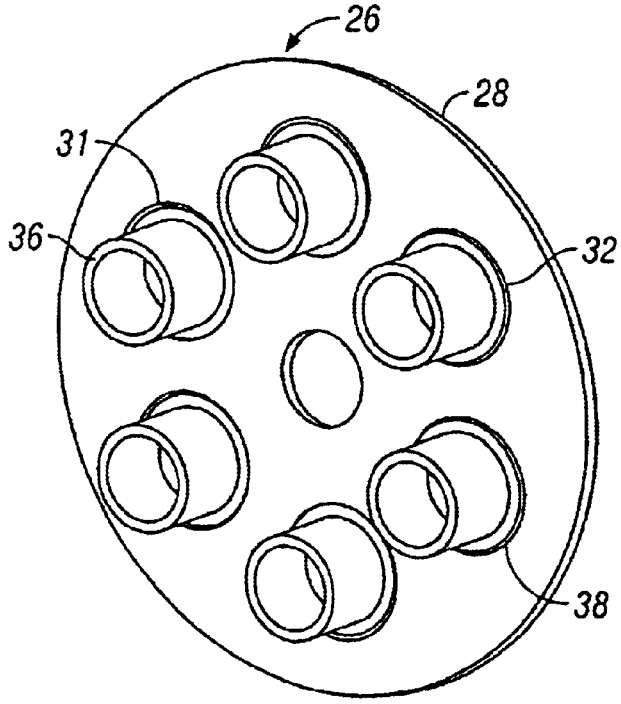
FIG. 3 is a cathode side perspective view of a flux equalizer assembly in accordance with one embodiment of the present invention.

FIG. 3 is a cathode side view of the flux equalizer assembly 26.

The flux equalizer assembly 26 is intended to be located in the cathode region of the device to provide proper magnetic field shaping and symmetry.

Figure 4:
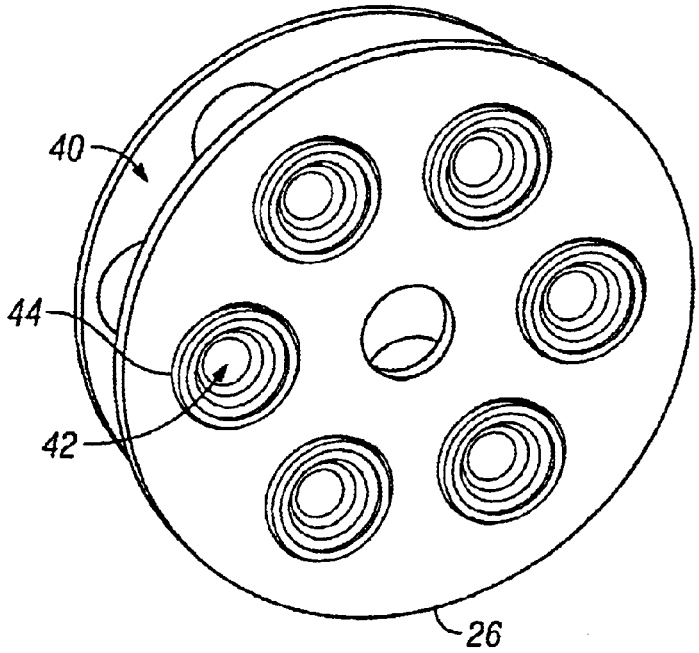
FIG. 4 is an anode side perspective view of the flux equalizer assembly mounted together with the cathode base assembly and the cathode flashlight assembly in accordance with one embodiment of the present invention.

FIG. 4 is an anode side perspective view of the flux equalizer assembly 26 mounted together with the cathode base assembly 40 and the cathode flashlight assembly 42 in accordance with one embodiment of the present invention. Each of the six off-axis apertures 30 of the flux equalizer assembly 26 surrounds one of the cathode flashlights 44.

Figure 5:
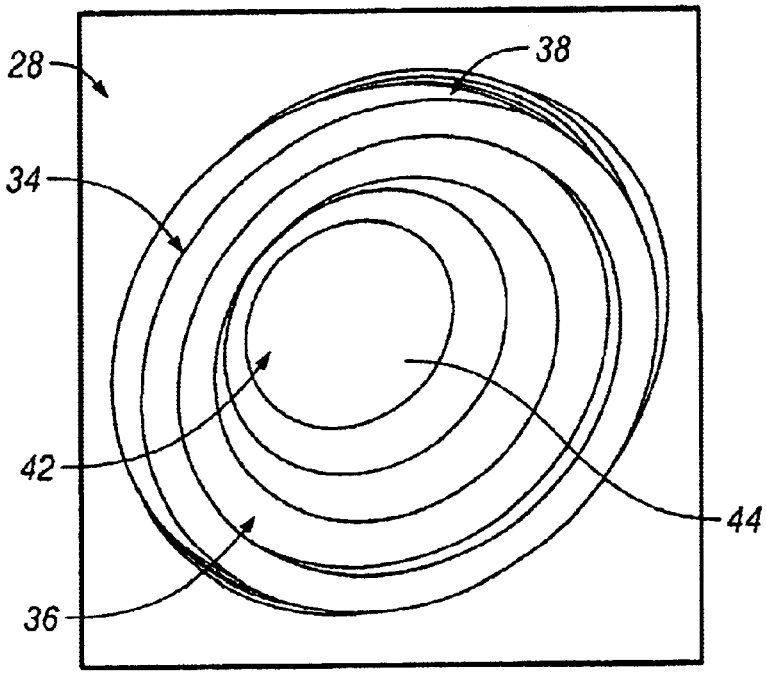
FIG. 5 is an anode side perspective view of one aperture of the flux equalizer assembly assembled to the cathode base assembly and cathode flashlight assembly in accordance with one embodiment of the present invention.

FIG. 5 is an anode side perspective view of one aperture of the flux equalizer assembly assembled to the cathode base assembly and cathode flashlight assembly. The cathode flashlights 44 are the individual cathode elements used to emit electrons for each individual beam.

With just flux plate 28 alone, the flux distribution would not be symmetric with respect to each beam axis. In particular, the magnetic flux density is higher toward the outer diameter of the flux plate since this is where the flux plate is physically closer to the magnetic circuit. As a result, with only the flux plate 28 there would still be a flux density gradient across each beam hole 30 with higher flux density at each beam edge where it is closest to the magnetic circuit (and farthest from its longitudinal axis). The equalization ring 34 and equalization cylinder 36 can be designed to achieve a nearly perfect flux symmetry locally for each beam. This is accomplished by greatly reducing the flux density gradient across the beam from one edge to the other by introducing the flux equalization ring 36. This ring is concentric to the beam axis it encloses. Referring back to FIGS. 2 and 3 it can now be appreciated that the beam holes 30 in flux plate 28 are somewhat larger in diameter than the flux equalization ring outer diameters. Moreover, the holes 30 in the flux plate 28 are on a somewhat larger bolt circle, relative to the solenoid axis, compared to the bolt circle containing the individual cathode flashlights 44. In one embodiment of the invention the flux equalization rings 34 are disposed in the beam holes 30 of the flux plate 28 such that they contact the flux plate at points nearest the longitudinal axis of the magnetic circuit (this is not required). Consequently, there is a higher-reluctance vacuum gap between the flux plate 28 and each flux equalization ring 34 at a point on each flux equalization ring where it is furthest from the magnetic circuit axis, which is precisely where the magnetic flux density would be highest if there were no flux equalization ring. At the same time, the flux equalization ring in this embodiment is in intimate contact (lowest achievable reluctance) with flux plate 28 at points nearest the longitudinal axis of the magnetic circuit, which is precisely where the magnetic flux density would be the lowest if there were no flux equalization ring. Thus, the outer diameter of the flux equalization ring 34 relative to the inner diameter of apertures 30, or equivalently the "flux equalization gap length" is a parameter used in this embodiment to achieve a nearly zero magnetic flux gradient from one side of the beam to the other by properly adjusting the reluctance across the gap.

Figure 6:
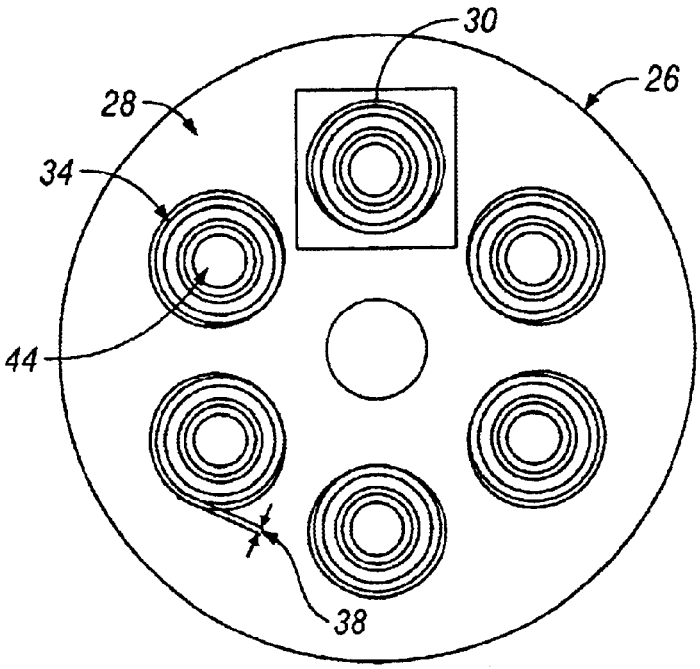
FIG. 6 is an anode side view of a flux equalizer assembly in accordance with one embodiment of the present invention.
Figure 7:
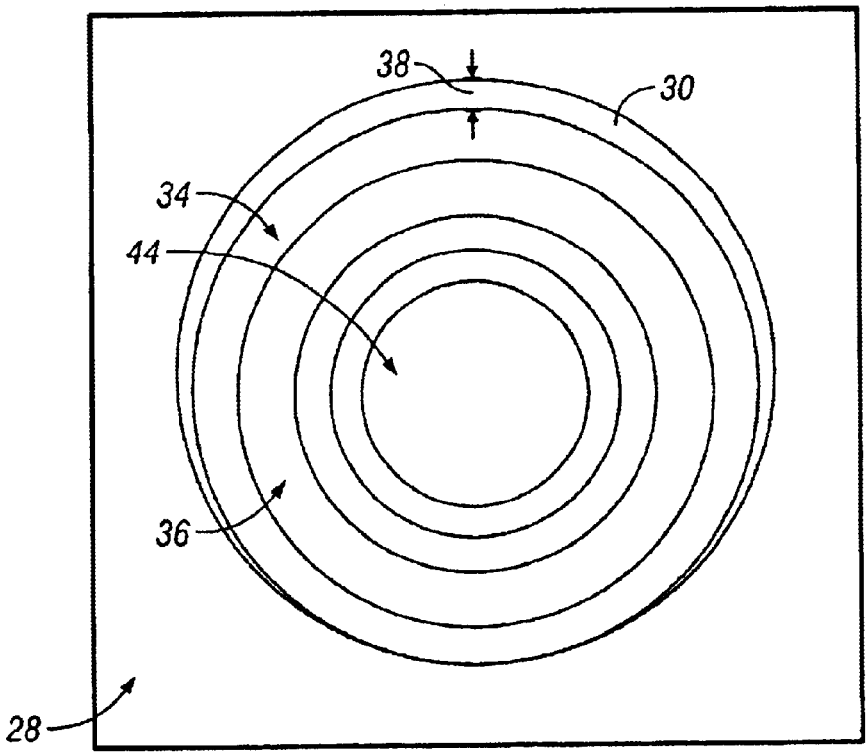
FIG. 7 is an anode side view enlargement of box 7 of FIG. 6.

Turning now to FIGS. 6 and 7, FIG. 6 is an anode side view of a flux equalizer assembly 26 and FIG. 7 is an enlarged anode side view of box 7 of FIG. 6. As shown in FIGS. 6 and 7 the size of the flux equalization gap continuously varies azimuthally around the beam. This is precisely what is needed to provide nearly perfect magnetic flux density symmetry for each beam. Without the flux equalization ring, the flux density gradient from one side of the beam to the other would be continuously varying azimuthally around the beam. With the flux equalization ring, the gap commensurately varies azimuthally to just balance out the magnetic flux density gradient from one side of the beam to the other. In accordance with additional embodiments of the invention, the flux equalization ring 34 need not be in intimate contact with the flux plate 28. The relative size of the flux equalization gap all around the beam can be designed to achieve the proper reluctance and consequently appropriate flux gradient compensation and excellent flux symmetry. In additional embodiments, the flux equalization ring 34 may be a discreet component mounted directly to the flux plate 28 or mounted via a non-ferromagnetic interface such as a vacuum compatible metal like copper, silver, tungsten, molybdenum, glass, ceramic (e.g., $Al_2O_3$, BeO, and the like). The flux equalization ring may be formed integral to the flux plate 28 as a precisely manufactured cutout in the flux plate using high precision machine techniques such as conventional milling, high-pressure water milling, electric discharge machining (EDM), and the like. Further modifications can be made to the flux equalization ring to further tailor flux equalization, high-voltage performance or simplified fabrication, including, but not limited to: adjusting the ring thickness (along the longitudinal axis of the device), adding tapers, controlling surface and thickness profiles, adding chamfers, radiuses, shape variations from the basic ring shape (e.g., elliptical or hyperbolic shapes), or adding mechanical support features.

The flux equalization cylinder 36 helps to maintain the highly symmetric magnetic flux density in the cathode region. There is one cylinder 36 per beam. The cylinder is disposed concentrically with the longitudinal beam axis. In one embodiment the cylinder 36 is in intimate contact with flux equalization ring 34 but this is not a requirement. Using just the flux equalization ring without the flux equalization cylinder would result in an asymmetric flux distribution and a flux gradient across the beam because of the relatively thin nature of the flux plate. If the flux plate 28 and the flux equalization ring 34 were fabricated with sufficient thickness then one could omit the flux equalization cylinder. This would, however, result in a relatively heavy structure and therefore many applications will find the use of a thin flux plate 28 and a thin flux equalization ring 34 coupled with a longer flux equalization cylinder 36 advantageous. This length of the flux equalization cylinders is important in achieving highly symmetric magnetic flux. In practice, the minimum length must be sufficient to ensure highly symmetric flux. Variations on the cylindrical flux equalization cylinders are possible. For example, they may include wall thickness variations along the length of the cylinder, wall thickness profiles, shape profiles (including cones) or non-circular cross-sections (such as elliptical or hyperbolic cross-sections) or cross-sectional profiles that vary along the length of the longitudinal cylinder axis. The flux equalization cylinder and the flux equalization ring may also be replaced by a single combined element resembling a long version of the flux equalization ring, but with a length comparable to the flux equalization cylinder.

Although the flux equalization ring 34 is functionally and conceptually a separate entity from the flux plate, it is actually an integral part of the flux plate in accordance with one embodiment of the present invention. This arrangement assists ease of manufacturing since the flux equalization gaps 38 can be produced easily using EDM or other common machining techniques. In alternative embodiments, flux equalization rings may be discrete parts connected to the flux plate or they may be integral to either the flux plate or to the flux equalization cylinders. It is also possible to fabricate the entire assembly of flux plate, flux equalization ring and flux equalization cylinder in a single process out of a single billet of material as will now be understood by those of ordinary skill in the art.

Figure 8:
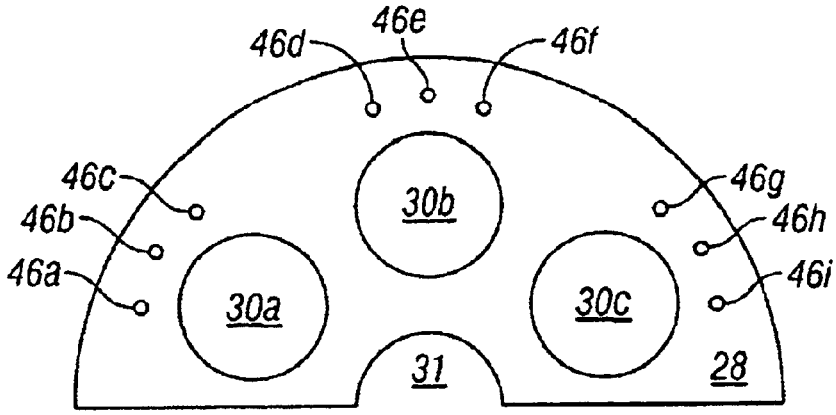
FIG. 8 is a front view of a flux plate illustrating another embodiment of the present invention.

FIG. 8 is a front view of a flux plate illustrating another embodiment of the present invention. In accordance with this embodiment, one or more small holes 46 (shown are 46*a*, . . . , 46*i*), which may be circular or of another suitable shape, are placed adjacent to the beam apertures 30 in flux plate 28. This approach approximates the continuously varying reluctance gap with small discrete holes 46 and eliminates the flux equalization ring. This approach has been found effective using static magnetic simulation tools as described below. In accordance with this embodiment, either a thick flux plate or a flux equalization cylinder is used as before but no separate flux equalization ring is required and the flux equalization gap is provided by the small holes 46. The local reluctance variation required to achieve proper flux equalization is provided by the small holes 46, which can now be understood by those of ordinary skill in the art to serve the same function as the flux equalization gap discussed above with respect to the embodiments of FIGS. 2–7. Those of ordinary skill in the art will also now realize that various shapes of apertures about the beam apertures 30 will provide the required reluctance variation and various cross-sectional shapes of flux equalization cylinders (as well as thick flux plates) will work. These arrangements can also be mixed in a particular design, if desired.

Figure 9:
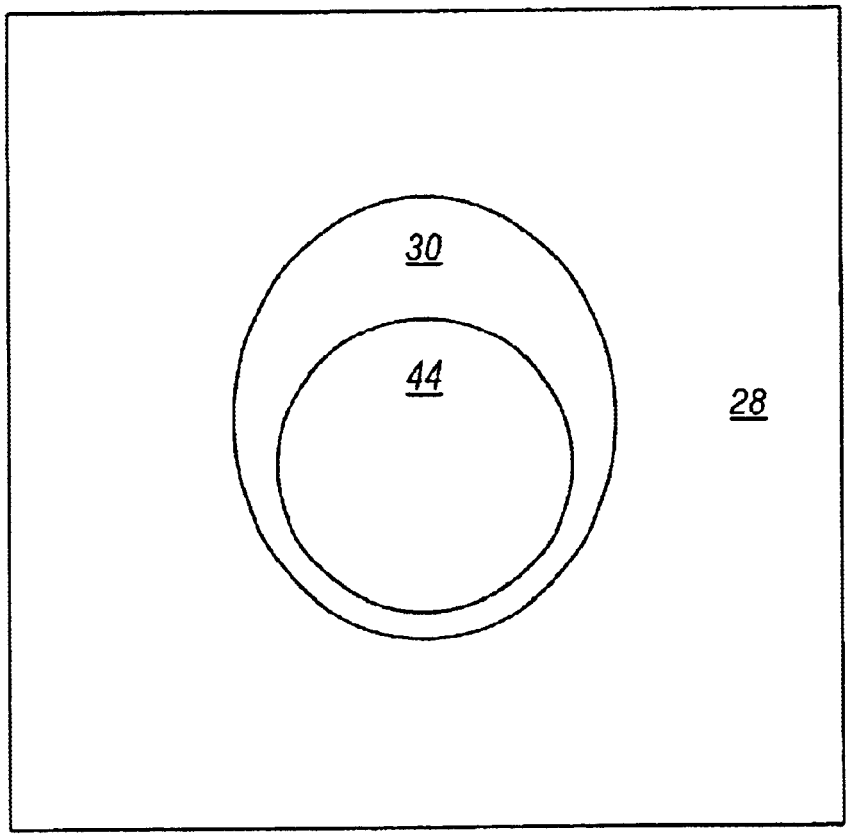
FIG. 9 is a front view of a flux plate illustrating yet another embodiment of the present invention.

FIG. 9 is a front view of a flux plate 28 illustrating another embodiment of the present invention. In accordance with this embodiment, the flux plate apertures 30 are stretched out of round in such a way as to produce a larger reluctance gap where needed, hence the apertures are non-circular. In accordance with this embodiment, no flux equalization ring is required but a flux equalization cylinder (not shown in this figure) is used and may be of the same cross-sectional shape as the aperture 30.

In accordance with the present invention, three-dimensional magneto-static solver computer design tools such as MAFIA (MAxwell's equations using the Finite Integration Algorithm) available from the National Energy Research Scientific Computing Center of Berkeley, Calif. and CST, the Computer Simulation Technology Company of Darmstadt, Germany), CST EMS, available from CST, MAXWELL 3D, available from the ANSOFT Corporation of Pittsburgh, Pa., ANSYS/Emag, available from ANSYS Incorporated of Canonsburg, Pa., and OPERA-3d with TOSCA, available from Vector Fields, Inc. of Aurora, Ill., are used in conjunction with cut and try analysis to take a specific proposed design and converge it on a final design having the desired magneto-static properties. The goal in each case is to create a magnetic perturbation in the flux plate which is equal in amplitude and opposite in direction in the area local to the off-axis beam aperture so as to achieve axisymmetric field conditions in the region containing the off-axis beam aperture. As more capable magneto-static solvers become available in the future, much of this process may be entirely automated.

All of the above-described versions will work as long as the following conditions are met: (1) there is a continuously varying reluctance gap (or approximately continuously varying as if fabricated with relatively small steps) acting as a flux perturbator to locally balance the flux from one side of the beam to the other and (2) local axisymmetric conditions are maintained relative to each beam axis for a sufficient distance behind the flux plate (i.e., in the direction of the cathode). Providing that these two conditions are met, the exact form taken by the flux equalizer assembly may vary in actual design details depending upon the electron gun operating parameters (beam voltage and beam current), the beam convergence and the shape and disposition of the electrostatic gun elements (cathode, focus electrode and anode) in order to adjust performance or manufacturability.

Some additional variations are also possible. There is no requirement that the flux plate be flat as in the example described above, so it may be curved slightly or some other shaping imposed on it. There may or may not be a central aperture 31 to the flux plate. This aperture, if present, will have a slight affect on the flux distribution and will, of course, result in a lighter flux plate and can provide mechanical access during device fabrication.

Figure 10:
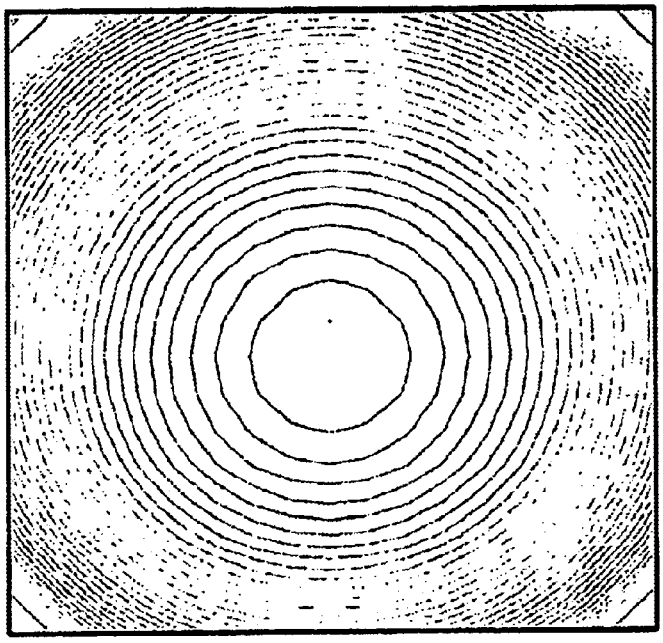
FIG. 10 is an anode-side view of calculated scalar magnetic equipotentials at the cathode in a plane perpendicular to one longitudinal beam axis of a multi-beam klystron that does not correct for magnetic field asymmetry.
Figure 11:
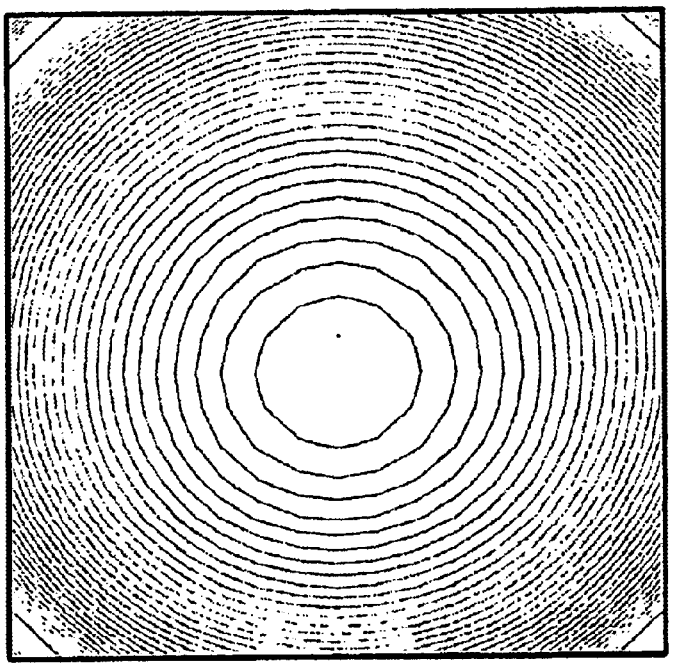
FIG. 11 is an anode-side view of calculated scalar magnetic equipotentials at a plane perpendicular to one longitudinal beam axis of a multi-beam klystron downstream from the cathode that does not correct for magnetic field asymmetry. that implements the embodiment illustrated in FIG. 8 to correct for magnetic field asymmetry.
Figure 12:
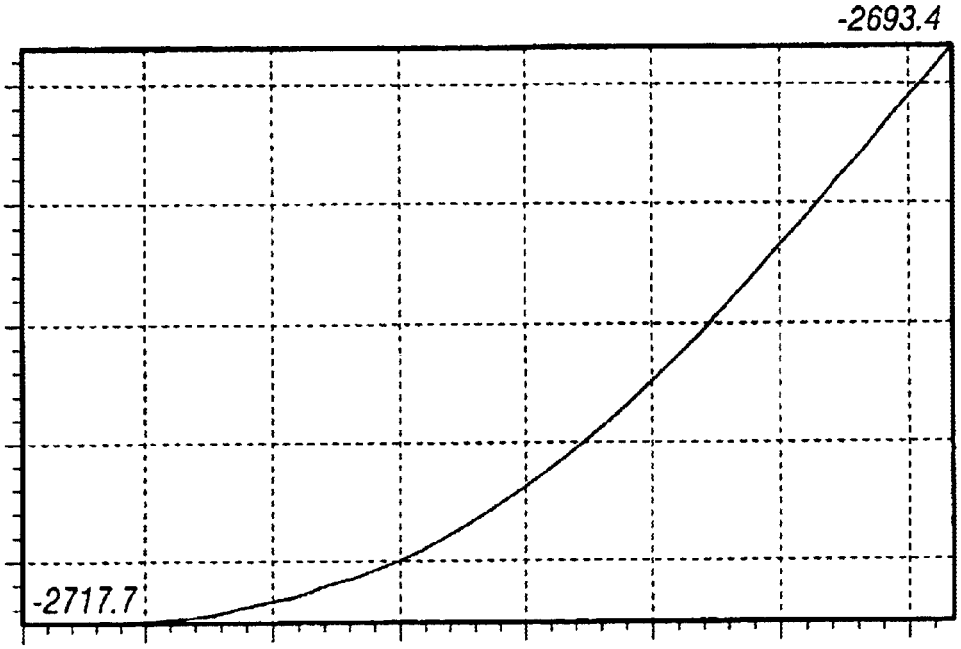
FIG. 12 is a plot showing variation of the scalar magnetic potential across the surface of the cathode in the direction of highest asymmetry of the magnetic field for the klystron of FIGS. 10 and 11.
Figure 17:
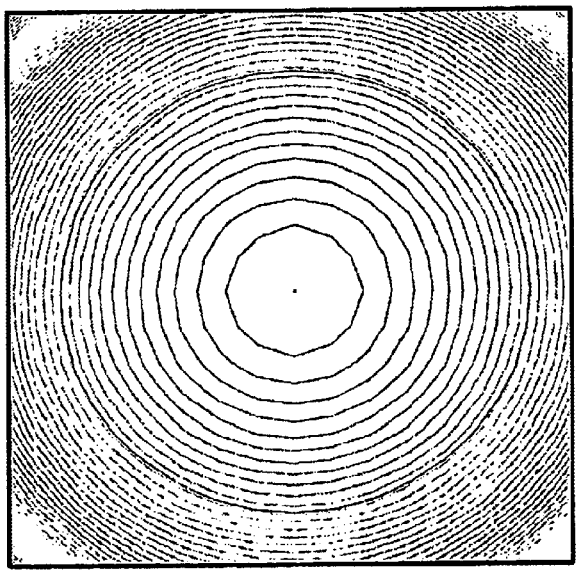
FIG. 17 is an anode-side view of calculated scalar magnetic equipotentials at the cathode in a plane perpendicular to one longitudinal beam axis of a multi-beam klystron
Figure 18:
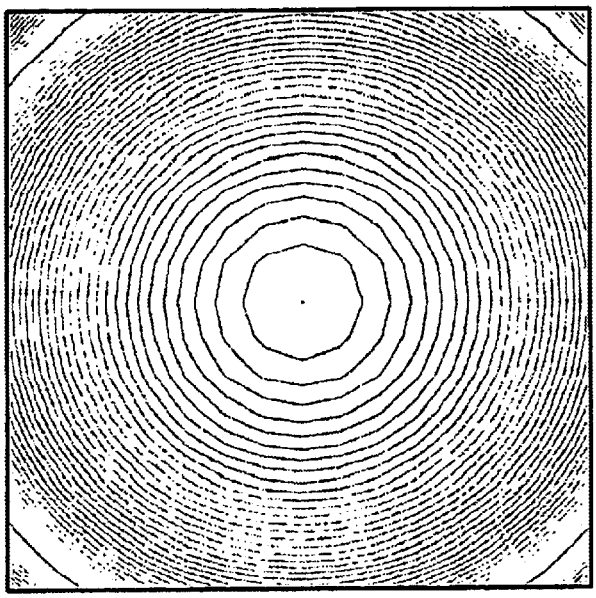
FIG. 18 is an anode-side view of calculated scalar magnetic equipotentials in a plane perpendicular to one longitudinal beam axis of a multi-beam klystron downstream from the cathode that implements the embodiment illustrated in FIG. 8 to correct for magnetic field asymmetry.
Figure 19:
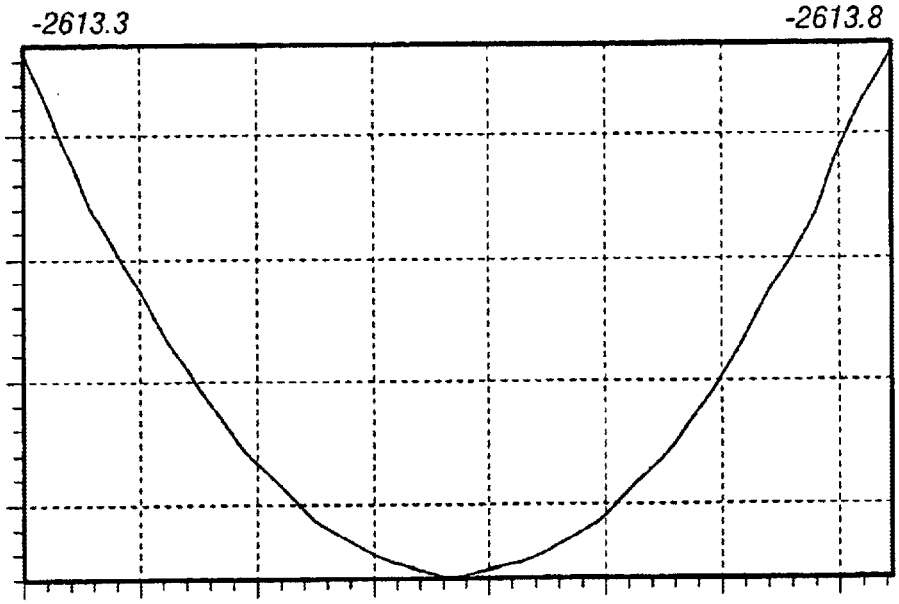
FIG. 19 is a plot showing variation of the scalar magnetic potential across the surface of the cathode in the direction of highest asymmetry of the magnetic field for the klystron of FIGS. 17 and 18.

FIGS. 10–12 present MAFIA analyses for a device built in accordance with the embodiments of FIGS. 2–7 but omitting the flux equalizer assembly and thereby omitting a flux compensation mechanism. FIGS. 13–16 present the MAFIA analyses for the same embodiments but including the flux equalizer assembly. FIGS. 17–19 present the MAFIA analyses for a flux equalized embodiment in accordance with FIG. 8.

FIG. 10 is a MAFIA analysis contour plot of scalar magnetic potential for the embodiment of FIGS. 2–7 but omitting the flux equalizer assembly. This plot is in a plane perpendicular to the beam axis and located at the cathode. The beam axis is shown as a dot in the center. For perfect symmetry of the magnetic field about the beam axis, the scalar magnetic potential contours would be a series of concentric circles centered on the beam axis dot. The analysis is approximate because MAFIA uses a discrete analysis mesh for its calculations. The potential contours are highly asymmetric (non-circular).

FIG. 11 is similar to FIG. 10 except this view is taken at a plane downstream from the cathode closer to the anode. The results are more symmetric (circular) but they are not centered on the beam axis (dot).

FIG. 12 is a plot showing variation of the scalar magnetic potential across the surface of the cathode in the direction of highest asymmetry of the magnetic field. Compared to FIG. 16 these results are clearly asymmetric from one side of the cathode to the opposite side. A high degree of symmetry is required to avoid beam twist. The shape of the curve from the center of the X-axis (which is the cathode center) out to the left edge (one edge of the cathode) must be nearly the same as the shape from the center out to the right edge.

Figure 13:
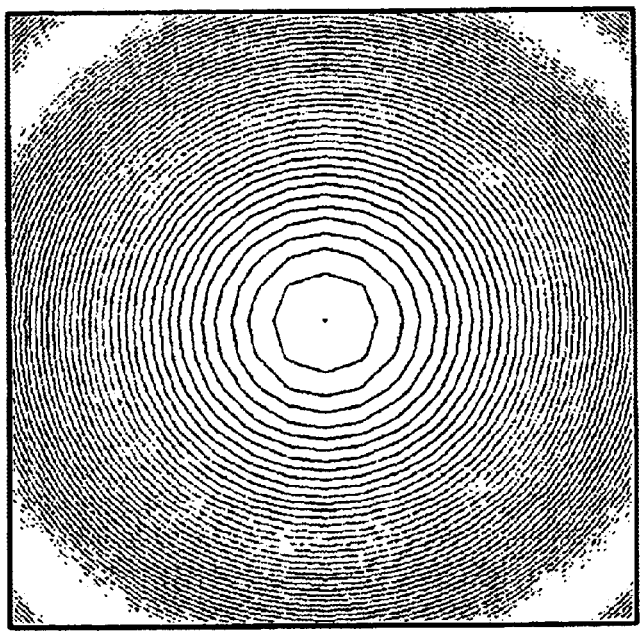
FIG. 13 is an anode-side view of calculated scalar magnetic equipotentials at the cathode in a plane perpendicular to one longitudinal beam axis of a multi-beam klystron that implements the embodiment illustrated in FIGS. 2–7 to correct for magnetic field asymmetry.

FIG. 13 is a MAFIA analysis contour plot of scalar magnetic potential for the embodiment illustrated in FIGS. 2–7 with the flux equalizer assembly included. This plot is in a plane perpendicular to the beam axis and located at the cathode. The beam axis is shown as a dot in the center. For perfect symmetry of the magnetic field about the beam axis, the scalar magnetic potential contours would be a series of concentric circles centered on the beam axis dot. The analysis is approximate because MAFIA uses a discrete analysis mesh for its calculations. Hence some of the circles are distorted by the mesh resolution (MAFIA draws straight lines between calculated points), not by the lack of magnetic field symmetry.

Figure 14:
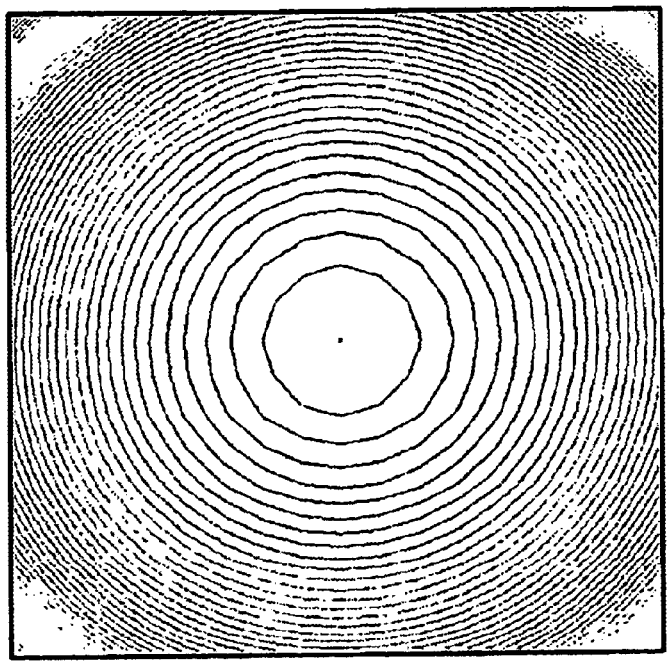
FIG. 14 is an anode-side view of calculated scalar magnetic equipotentials in a plane perpendicular to one longitudinal beam axis of a multi-beam klystron downstream from the cathode that implements the embodiment illustrated in FIGS. 2–7 to correct for magnetic field asymmetry.

FIG. 14 is similar to FIG. 13 except this view is taken at a plane downstream from the cathode closer to the anode. These two plots demonstrate that excellent magnetic field symmetry is maintained throughout the gun region.

Figure 15:
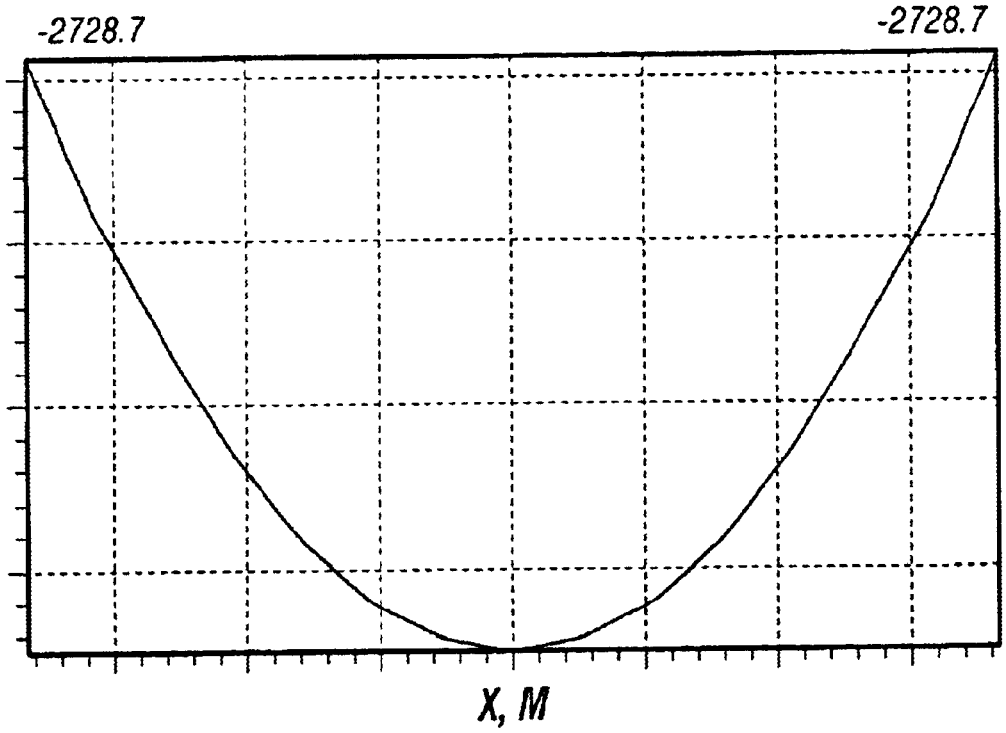
FIGS. 15 and 16 are plots showing variation of the scalar magnetic potential across the surface of the cathode in two orthogonal planes (X and Y, respectively) illustrating the symmetry of the corrected magnetic field. The numbers listed at the tops of each plot are the values of scalar magnetic potential at the edges of the cathode. For perfect symmetry, these numbers would be identically equal. These four numbers are all within 0.03% of each other indicating excellent symmetry.
Figure 16:
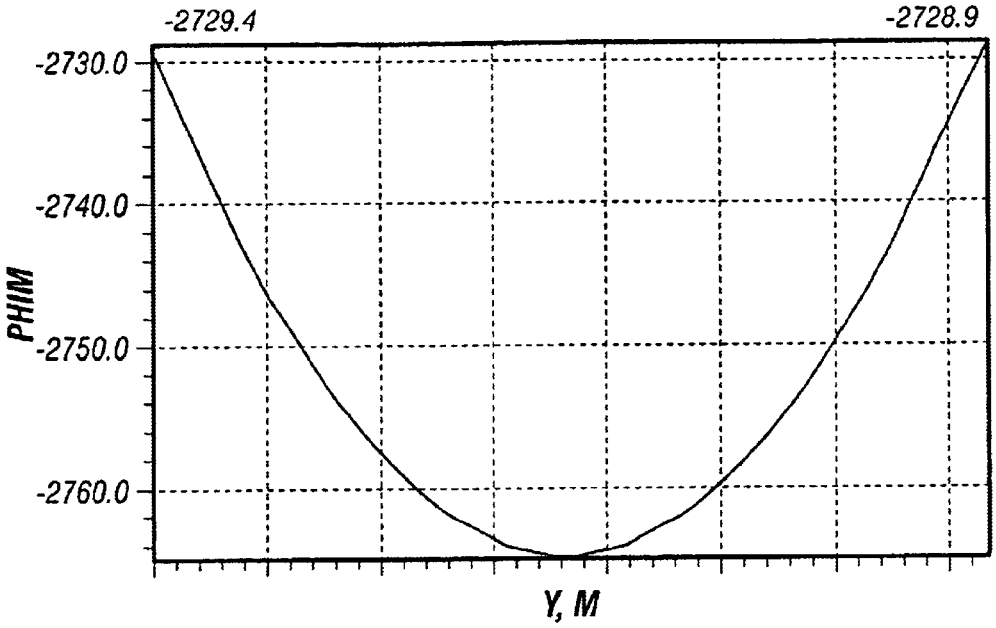

FIGS. 15 and 16 show variation of the scalar magnetic potential across the surface of the cathode in two orthogonal planes (X and Y, respectively) showing the symmetry of the magnetic field. The numbers listed at the tops of each plot are the values of scalar magnetic potential at the edges of the cathode. For perfect symmetry, these numbers would be identically equal. These four numbers are all within 0.03% of each other indicating excellent symmetry.

FIG. 17 is an anode-side view of calculated scalar magnetic equipotentials at the cathode in a plane perpendicular to one longitudinal beam axis of a multi-beam klystron that implements the embodiment illustrated in FIG. 8 to correct for magnetic field asymmetry. This shows analogous results to FIG. 13.

FIG. 18 is an anode-side view of calculated scalar magnetic equipotentials in a plane perpendicular to one longitudinal beam axis of a multi-beam klystron downstream from the cathode that implements the embodiment illustrated in FIG. 8 to correct for magnetic field asymmetry. This shows analogous results to FIG. 14.

FIG. 19 is a plot showing variation of the scalar magnetic potential across the surface of the cathode in the direction of highest asymmetry of the magnetic field for the klystron of FIGS. 17 and 18.

The above-described invention results in a highly axisymmetric magnetic flux in the region of the guns and cathodes so that the electron beams do not experience significant twisting. Since offset apertured pole pieces are not required in the gun, the multi-beam device employing the present invention can operate over a wide range of operating conditions instead of being limited to a fixed set of operating conditions.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. An electron beam device having a longitudinal axis, comprising:

a source of a plurality of electron beams disposed apart from the longitudinal axis, the plurality of electron beams arranged to form between said source and a collector assembly;

a flux equalization assembly disposed between said source and said collector assembly and relatively near said source, said flux equalization assembly including: (1) a flux plate formed of a ferromagnetic material, the flux plate including at least one aperture for each of the plurality of electron beams, an aperture wall defining the aperture and (2) a flux equalization ring disposed concentrically about each of the plurality of electron beams and forming an azimuthally varying gap between said flux ring and a corresponding aperture wall; and a source of a magnetic field disposed to focus the electron beams, wherein the electron beams travel between the source and the collector in a substantially straight path parallel to the longitudinal axis of the device.

2. The electron beam device in accordance with claim 1 wherein said flux equalization ring and said flux plate are in contact at least at one place.

3. The electron beam device in accordance with claim 1 wherein said source of a magnetic field is a solenoid disposed about the electron beam device.

4. An electron beam device having a longitudinal axis, comprising:

a source of a plurality of electron beams disposed apart from the longitudinal axis, the plurality of electron beams arranged to form between said source and a collector assembly;

a flux equalization assembly disposed between said source and said collector assembly and relatively near said source, said flux equalization assembly including: (1) a flux plate formed of a ferromagnetic material, the flux plate including at least one aperture for each of the plurality of electron beams, an aperture wall defining the aperture; (2) a flux equalization ring disposed concentrically about each of the plurality of electron beams and forming an azimuthally varying gap between said flux equalization ring and a corresponding aperture wall and (3) a flux equalization cylinder disposed concentrically about each of said plurality of electron beams; and a source of a magnetic field disposed to focus the electron beams, wherein the electron beams travel between the source and the collector in a substantially straight path parallel to the longitudinal axis of the device.

5. The electron beam device in accordance with claim 4 wherein said flux equalization rings and said flux plates are in contact at least at one place.

6. The electron beam device in accordance with claim 4 wherein said flux equalization rings and said flux equalization cylinders are in contact.

7. The electron beam device in accordance with claim 6 wherein said flux equalization rings and said flux plates are in contact at least at one place.

8. The electron beam device in accordance with claim 4 wherein said source of a magnetic field is a solenoid disposed about the electron beam device.

9. An electron beam device having a longitudinal axis and a magnetic circuit providing a magnetic focusing field disposed about the longitudinal axis focusing the electron beam(s) to a first diameter, the device having at least one electron beam disposed parallel to and a distance from said longitudinal axis, the device comprising:

a cathode associated with said at least one electron beam;

an anode associated with said at least one electron beam; and a flux equalization assembly disposed between said anode and said cathode, said flux equalization assembly including a ferromagnetic flux plate having a beam aperture through which said at least one electron beam is arranged to pass, said flux equalization assembly including local magnetic perturbators acting to cancel local magnetic field asymmetry, and said flux equalization assembly including a portion extending toward said cathode to surround at least a portion of the at least one electron beam in a region adjacent the cathode where it is of greater diameter than said first diameter.

10. The electron beam device in accordance with claim 9 wherein said magnetic circuit comprises a solenoid.

11. The electron beam device in accordance with claim 9 wherein said perturbators include at least one aperture per beam aperture.

12. The electron beam device in accordance with claim 9 wherein said beam perturbators include three apertures per beam aperture.

13. The electron beam device in accordance with claim 9 wherein said beam perturbators include a flux equalization ring having an outer cross-sectional shape different from the inner cross-sectional shape of the beam aperture.

14. The electron beam device in accordance with claim 13 wherein said flux equalization ring and said flux plate are in contact at least at one place.

15. The electron beam device in accordance with claim 9 wherein said flux equalization assembly extension toward the cathode is accomplished with a relatively thick flux plate.

16. The electron beam device in accordance with claim 9 wherein said flux equalization assembly extension toward the cathode is accomplished with a flux equalization cylinder.

17. An electron beam device having a longitudinal axis and a magnetic circuit providing a magnetic focusing field disposed about the longitudinal axis focusing the electron beam(s) to a first diameter, the device having at least one electron beam disposed parallel to and a distance from said longitudinal axis, the device comprising:

a cathode associated with said at least one electron beam;

an anode associated with said at least one electron beam; and a flux equalization assembly disposed between said anode and said cathode, said flux equalization assembly including a ferromagnetic flux plate having a beam aperture through which said at least one electron beam is arranged to pass, said flux equalization assembly including one or more magnetic perturbators local to and associated with said at least one electron beam and acting to cancel local magnetic filed asymmetry in said at least one electron beam.

18. The electron beam device in accordance with claim 17 wherein said magnetic circuit comprises a solenoid.

19. The electron beam device in accordance with claim 17 wherein said perturbators include at least one aperture per beam aperture.

20. The electron beam device in accordance with claim 17 wherein said beam perturbators include three apertures per beam aperture.

21. The electron beam device in accordance with claim 17 wherein said beam perturbators include a flux equalization ring having an outer cross-sectional shape different from the inner cross-sectional shape of the beam aperture.

22. The electron beam device in accordance with claim 21 wherein said flux equalization ring and said flux plate are in contact at least at one place.

23. The electron beam device in accordance with claim 17 wherein said flux equalization assembly extends toward the cathode by way of a relatively thick flux plate.

24. The electron beam device in accordance with claim 17 wherein said flux equalization assembly extends toward the cathode by way of a flux equalization cylinder.

* * * * *

UNITED STATES PATENT AND TRADEMARK OFFICE

CERTIFICATE OF CORRECTION

PATENT NO. : 6,856,081 B2
DATED : February 15, 2005
INVENTOR(S) : Cattelino et al.

It is certified that error appears in the above-identified patent and that said Letters Patent is hereby corrected as shown below:

Column 4,
Lines 5 and 6, delete "that implements the embodiment illustrated in FIG. 8 to correct for magnetic field asymmetry.".
Line 32, after "of a multi-beam klystron", insert -- that implements the embodiment illustrated in FIG. 8 to correct for magnetic field asymmetry. --.

Signed and Sealed this

Twenty-third Day of August, 2005

JON W. DUDAS
*Director of the United States Patent and Trademark Office*